US012595676B2

(12) United States Patent
Ju

(10) Patent No.: US 12,595,676 B2
(45) Date of Patent: Apr. 7, 2026

(54) HINGE-TYPE CONNECTOR FOR CONNECTING ONE-TOUCH FOLDING TENT FRAME MEMBERS

(71) Applicant: BAEJIN CORPORATION, Seoul (KR)

(72) Inventor: Dong Soo Ju, Seoul (KR)

(73) Assignee: BAEJIN Corporation, Seoul (KR)

( * ) Notice: Subject to any disclaimer, the term of this patent is extended or adjusted under 35 U.S.C. 154(b) by 217 days.

(21) Appl. No.: 18/607,575

(22) Filed: Mar. 18, 2024

(65) Prior Publication Data

US 2025/0290343 A1 Sep. 18, 2025

(51) Int. Cl.

| | |
|---|---|
| ***E04H 15/48*** | (2006.01) |
| ***E04H 15/40*** | (2006.01) |
| ***E04H 15/60*** | (2006.01) |
| *E04H 15/42* | (2006.01) |

(52) U.S. Cl.
CPC ..... *E04H 15/405* (2013.01); *E04H 15/60* (2013.01); *E04H 15/42* (2013.01)

(58) Field of Classification Search
CPC ..... E04H 15/42; E04H 15/48; E04H 15/60; E04H 15/405; Y10T 403/32409; Y10T 403/32319; Y10T 403/32073; Y10T 403/32262; Y10T 403/32606; E05D 2011/0036; E05D 2011/0045
USPC ..... 135/74, 114, 143, 144, 151, 154; 403/102, 113, 119; 16/348, 357, 361
See application file for complete search history.

(56) References Cited

U.S. PATENT DOCUMENTS

| | | | | |
|---|---|---|---|---|
| 5,195,551 A * | 3/1993 | Ju | E04H 15/48 | 403/101 |
| 7,942,159 B2 * | 5/2011 | Choi | E04H 15/42 | 135/147 |
| 2007/0023074 A1 * | 2/2007 | Choi | E04H 15/48 | 135/130 |
| 2013/0014358 A1 * | 1/2013 | Jin | E04H 15/54 | 24/595.1 |

FOREIGN PATENT DOCUMENTS

| | | |
|---|---|---|
| KR | 20-0129575 Y1 | 12/1998 |
| KR | 20-0331627 Y1 | 11/2003 |

* cited by examiner

*Primary Examiner* — Robert Canfield
(74) *Attorney, Agent, or Firm* — NKL Law; Jae Youn Kim

(57) ABSTRACT

Provided relates to a hinge-type connector for connecting one-touch folding tent frame members that comprise: at least 4 base frame members and at least 2 frame members on the free end of each base frame that is connected in a line by a hinge-type connector; a spring that presses the sleeve toward the locking direction of the fixed hinge and a spring seat for supporting the lower end of the spring.

7 Claims, 10 Drawing Sheets

HINGE-TYPE CONNECTOR FOR CONNECTING ONE-TOUCH FOLDING TENT FRAME MEMBERS

TECHNICAL FIELD

The present invention relates to a hinge-type connector for connecting frame members of a one-touch folding tent with at least four base frame members combined to be foldable on the hub and at least two frame members connected to be foldable to the free end of each base frame. The hinge-type connector of the present invention is mounted on the end of the second or a subsequent frame member to insert a sleeve for compressing a spring into the end of the frame member, fixes the sleeve without welding or bonding, and can fully protect the hinge shaft, the fixed hinge, and the swing hinge by solving the problem that the swing hinges belonging to the base frames and the fixed hinges on the first and subsequent frame members work loose around the hinge shaft when the base frame members are unfolded from the hub.

BACKGROUND ART

Among the types of camping tent frames, a frame that can be folded and unfolded easily and quickly with one touch is known.

In the conventional one-touch folding tent frame introduced in FIG. 1, at least four base frame members (2) are connected radially on a single hub (1) so that they can be folded inwardly and unfolded outward like a parasol.

FIG. 2 introduces the structure of the frame members: at least two frame members (3~5) are arranged in a line on the free end of each base frame member (2), and the connecting end of the first frame member (3) is connected to the free end of the base frame (2) by a hinge-type connector (6), so when the tent is unfolded, the base frame members (2) and the first and subsequent frame members (3~5) are unfolded like a parasol, and when the tent is folded, each frame member is folded in a W shape.

(2), and a fixed hinge (30) is connected to the end of the opposite first frame member (3).

The first frame member (3) and the second frame member (4), and the second frame member (4) and the third frame member (5) are arranged in a line, respectively, and connected with a foldable connector (6) of the same type as above.

The first problem pointed out as requiring improvement in this conventional hinge-type connector is the structure of the spring seat (10) installed on the fixed hinge (30) as shown in FIG. 3.

That is, conventionally, the spring seat (10) was inserted into the frame member of the fixed hinge (30), the position was determined, and then the lower end(S) of the spring seat was fixed to the frame member by welding with synthetic resin or bonding with adhesive.

However, welding with synthetic resin has a problem in that it ages prematurely and cracks due to the material difference between the frame member and the spring seat, eventually causing the spring seat to become loose. The bonding also has a problem in that adhesion itself is not easy due to the difference in material with the first frame member, and as the adhesive ages, the spring seat is loosened, and the sleeve slides down without overcoming the reaction force of the spring pressed in the spring groove of the sleeve, and as a result, the spring loses elasticity, and the sleeve does not perform its role.

According to Prior Art Document No. 20-012975, a spring sheet made of synthetic resin has a C-shaped protrusion ring installed on its inner surface, and a C-shaped groove ring is formed on the opposite column made of synthetic resin. In this prior art structure, since the protruding ring made of synthetic resin has no elasticity, it is difficult to force it up into the column, and the protruding ring is often torn or broken in the process of forcibly pushing up to the position of the grooved ring. In addition, if an extended protrusion ring is used, play and deformation occur, and it may fall out of the grooved ring without overcoming the repeated pressing and repulsive force of the spring.

The spring must always maintain the correct posture to support the sleeve to move up and down normally and to securely lock the unfolded swing hinge.

To do this, the spring should be held upright without losing its center so that the center of the lower end of the spring is aligned with the spring seat on which the lower end of the spring depends.

Also, the bottom of the conventional spring seat is uneven or eccentric, so when the frame member is folded and unfolded, the lower end of the spring loses its center, causing the sleeve to wobble and making the sleeve engage unstably with the locking lug of the swing hinge.

On the other hand, a gap inevitably remains between the swing hinge and the fixed hinge. It may vary depending on the degree of the gap, if a strong wind or gust of wind comes from the side of the frame when the tent is unfolded, or if the frame is stepped on or caught by someone passing by the tent, the frame member may be twisted. If the frame member twists badly, the hinge shaft may be compressed by the fixed hinge and deform or the wings of the swing hinge may be damaged.

PRIOR ART DOCUMENTS

[Doc 1] Registered Utility Model No. 20-0129575
[Doc 2] Registered Utility Model No. 20-0331627

SUMMARY OF INVENTION

Technical Problem

With respect to a hinge-type connector for a one-touch folding tent frame, provided with a spring for pressing the sleeve in a direction to lock the fixed hinge and a spring seat for supporting the lower end of the spring, and connecting at least 4 base frame members and at least 2 frame members lined up at the free end of each base frame, the present invention aims to provide a connector for connecting one-touch folding tent frame members that can easily and securely fix the spring seat without welding or bonding.

Another object of the present invention is to compensate for defects in the hinge part of the frame. The present invention seeks a hinge-type connector for a one-touch folding tent frame that allows the first frame member and subsequent frame members to fold automatically when the base frame member is folded, while preventing deformation and damage of the hinge by improving the structure so that the fixed hinge does not move to the left and right of the hinge shaft as well as in the circumferential direction when the frame is unfolded, and keeping the unfolded tent stable by stabilizing the unfolded state of the frame members.

Solution to Problem

The first object of the present invention is to provide a hinge-type connector for connecting one-touch folding tent frame members that connect a swing hinge fixed to the base frame member or the first and subsequent frame members to a fixed hinge attached to the opposite frame member so that they can be folded and unfolded around the hinge shaft, pushes up the sleeve installed on the fixed hinge to lock the locking lug of the unfolded fixed hinge, and has a spring seat fitted into the first frame member and the second and subsequent frame members to support the lower end of the spring built into the sleeve so as to always apply upward pressure to the sleeve. The hinge-type connector for connecting one-touch folding tent frame members forms a fastening groove in the connection part of the frame member on the fixed hinge side to prevent backward separation and has an inclined stopper with an inner diameter smaller than the outer diameter of the connection part inside the lower end of the spring seat. When the stopper is forcibly fitted through the lower end of the connection part, it is elastically pushed and bent downward as much as the difference with the outer diameter of the connection part, and is elastically contracted and locked when its inner end passes the boundary of the fastening groove.

The second object of the present invention is to provide a hinge-type connector for connecting one-touch folding tent frame members, consisting of a fixed hinge with a keyway in which the key of the swing hinge is locked in the unfolded state, and a swing hinge with a key that is locked by being coupled to the keyway of the fixed hinge. When the swing hinge is fully extended and inserted into the keyway, the fixed hinge does not wobble to the left and right of the hinge shaft or in the circumferential direction.

Beneficial Effects

According to the first solution of the present invention, while conventional welding or bonding is excluded, the spring seat is fixed in a fastening groove by a stopper that has a straight rear surface, sharp end, and inclined upper surface, so that it can only move forward and not backward. When the spring seat is forcibly inserted into the fastening groove formed in the frame of the fixed hinge, the stopper flexibly rises in a bent and deformed state and falls into the fastening groove to restore its original shape (original shape), performing the stopper function with a stable binding force. Therefore, in the present invention, it is very easy to fix the spring seat compared to the conventional method, and the fixed state does not change all the time, so fixing the spring seat is highly reliable.

In addition, the assembly of the connector is improved as much as the spring seat is easily fixed.

When the first frame member or the second and subsequent frame members are unfolded, the key of the swing hinge is tightly inserted into the keyway of the fixed hinge, so even if the frame member shakes or twists sideways, the fixed hinge does not move and the tent is stably unfolded, reducing concerns about the distortion of the hinge shaft and damage to the swing hinge due to the movement of the fixed hinge.

BEST MODE FOR CARRYING OUT THE INVENTION

Figure 1:
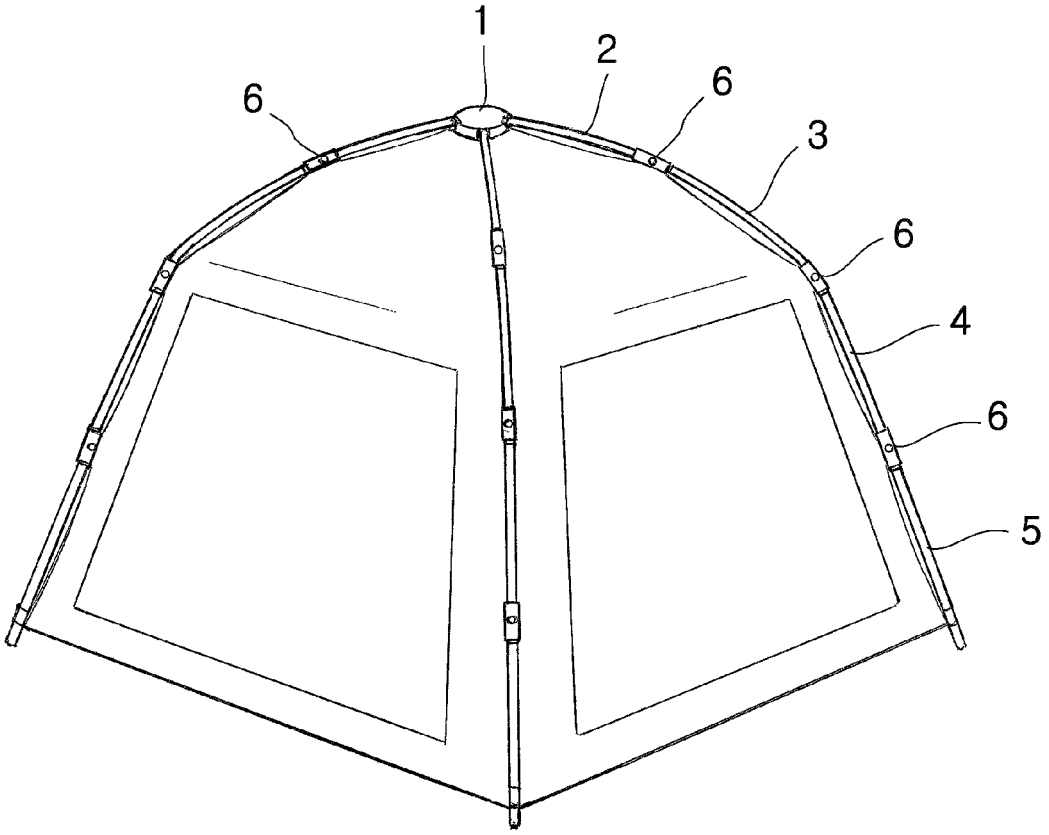
FIG. 1 is an unfolded state diagram of a tent with a one-touch folding frame applied.
Figure 2:
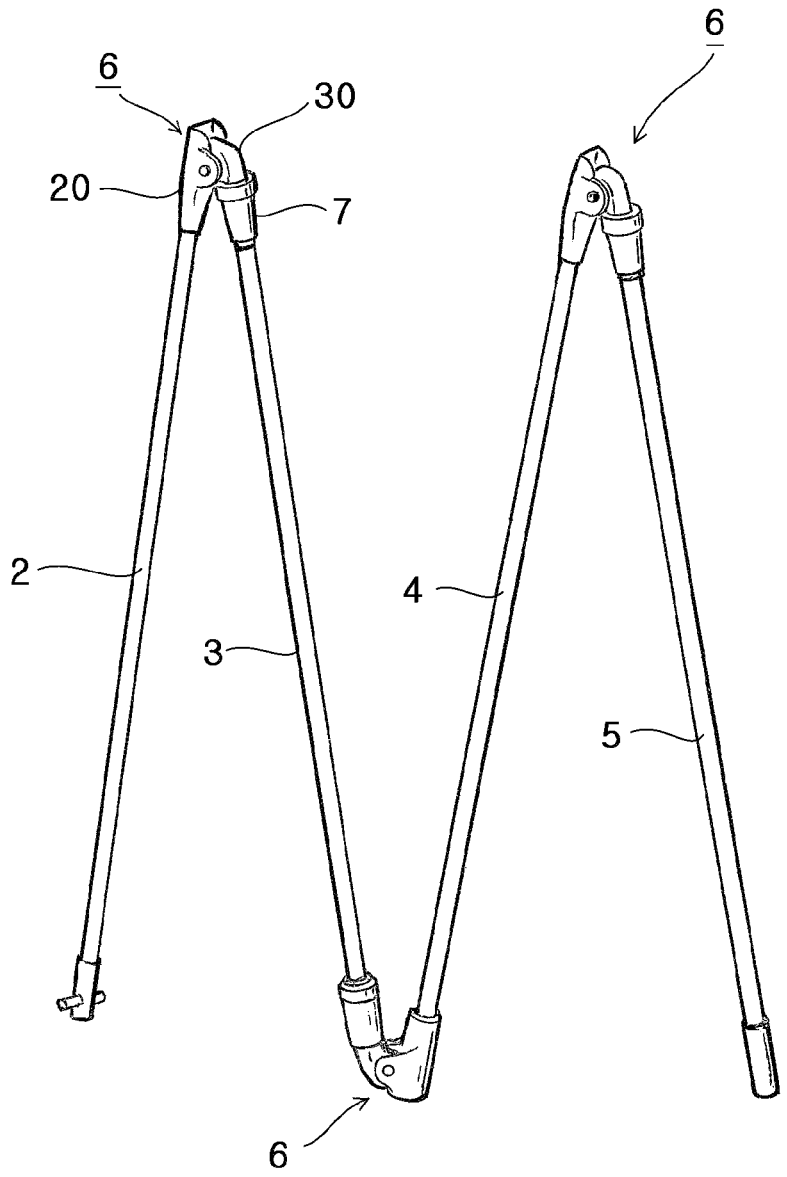
FIG. 2 is a folded state diagram of the frames connected by a hinge-type connector.

Concerning the drawings created based on the preferred embodiments, a hinge-type connector capable of implementing the first and second objects of the present invention will be described.

The following description is not limited to the present embodiments, and simple design changes, additions of additional matters, etc. that can be easily implemented by those of ordinary skill in the art from the accompanying drawings and detailed description are regarded as belonging to the technical spirit of the present invention.

According to the present invention, the hinged connector (6) is also useful for connection between the first frame member (3) and the second frame member (4), between the second frame member (4) and the third frame member (5) as well as between the fourth frame member and a subsequent frame member.

The hinge-type connector (6) is an articulated joint consisting of a combination of a swing hinge (20) and a fixed hinge (30) formed as a single unit at the tip of each frame member, and first, a sleeve (7) elastically installed on the fixed hinge (30) will be described.

The sleeve (7) is a hollow through which the fore-end of the frame member (3) can pass, and is assembled to be positioned under the stopper (33) formed in the upper half of the fixed hinge (30).

At the upper end of the body of the sleeve (7), a socket pipe (71) is formed as a single body, and when the sleeve (7) is pushed up to the spring (9), the socket pipe (71) bites and locks the locking lug (23) at the bottom of the swing hinge (20) on its inner surface.

The sleeve (7) has a top dead center where the bottom (72) of the inner surface of the socket pipe (71) located at the top stops in contact with the stopper (33), and a bottom dead center where the swing hinge (20) is folded to compress the spring (9) while the locking lug (23) pushes the sleeve (7) out of the socket pipe (71). As soon as the locking lug (23) leaves the inner surface of the socket pipe (71), the sleeve (7) is pushed up and returned as the contracted spring (9) expands.

An annular fastening groove (34) for fixing the spring seat is formed at the lower end of the connection part (31) of the fixed hinge (30). The fastening groove (34) is a locking groove of the stopper (11) for fixing the spring seat (10) by forcibly covering the lower end of the connection part (31).

The stopper (11) is formed at the inner lower end of the spring seat (10). And the inner diameter of the stopper (11) is slightly smaller than the outer diameter of the connection part (31). For example, if the connection part (31) is 10 mm, the inner diameter of the stopper (11) is designed to be 9 mm.

If the spring seat (10) is made of a hard synthetic resin or a light metal such as aluminum, it is not elastic, so even if it is forcibly inserted from the lower end of the connection part (31), it cannot be inserted. In consideration of this point, the spring seat (10) is made of a synthetic resin that is tough and flexible like PE.

The stopper (11) is long and has a pointed end, but a lower surface is formed as a straight surface and an upper surface is formed as an inclined surface. The end portion is configured to have the flexibility and bending elasticity.

In addition, the fastening groove (34) into which the stopper (11) is fitted is also formed in the same shape and structure as the stopper. Specifically, the fastening groove (34) has a straight lower surface and an inclined upper surface to form a sharp groove structure.

Figure 5:
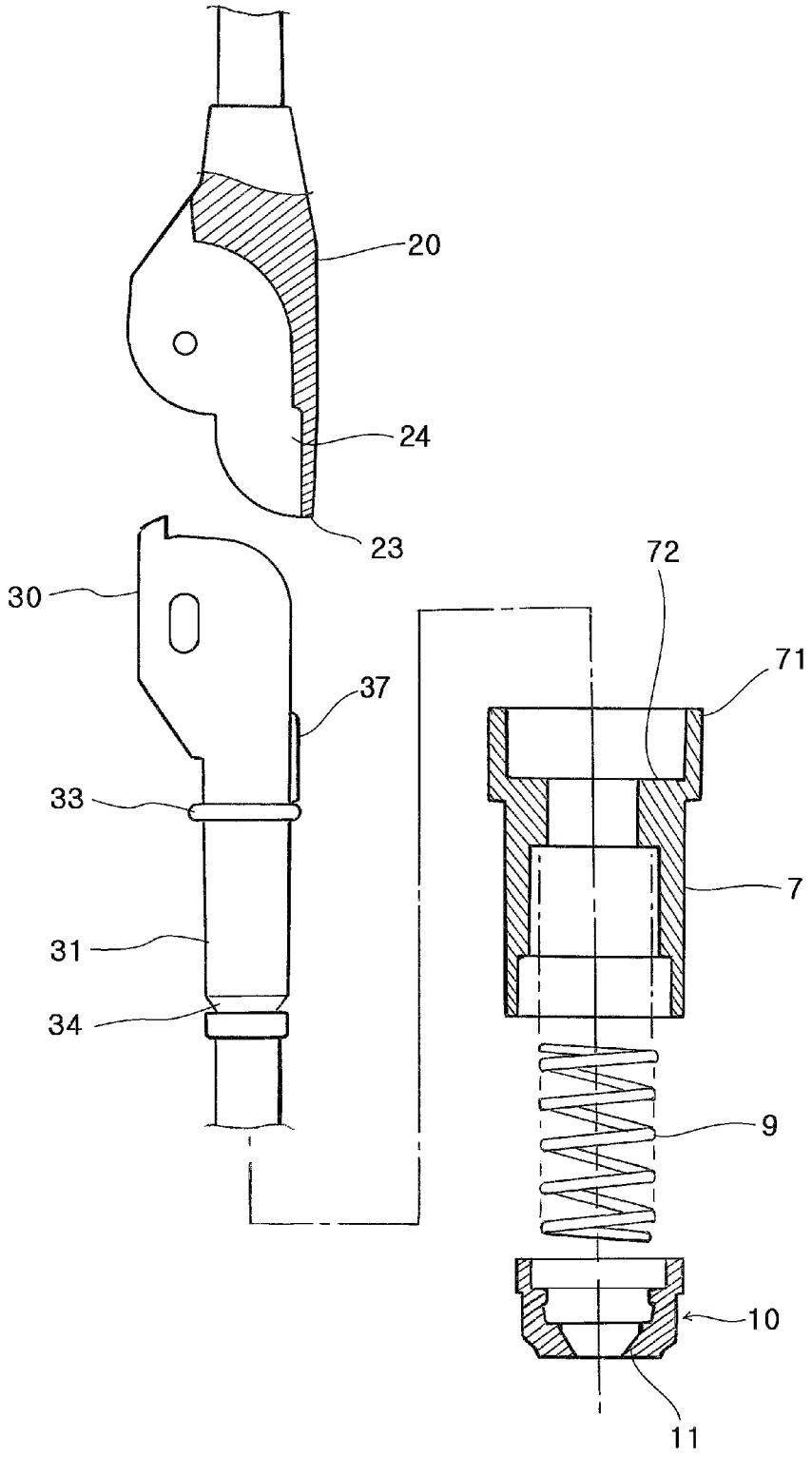
FIG. 5 is an exploded view showing the non-welding non-adhesive spring seat applied to the connection part on the frame members of the present invention.
Figure 6:
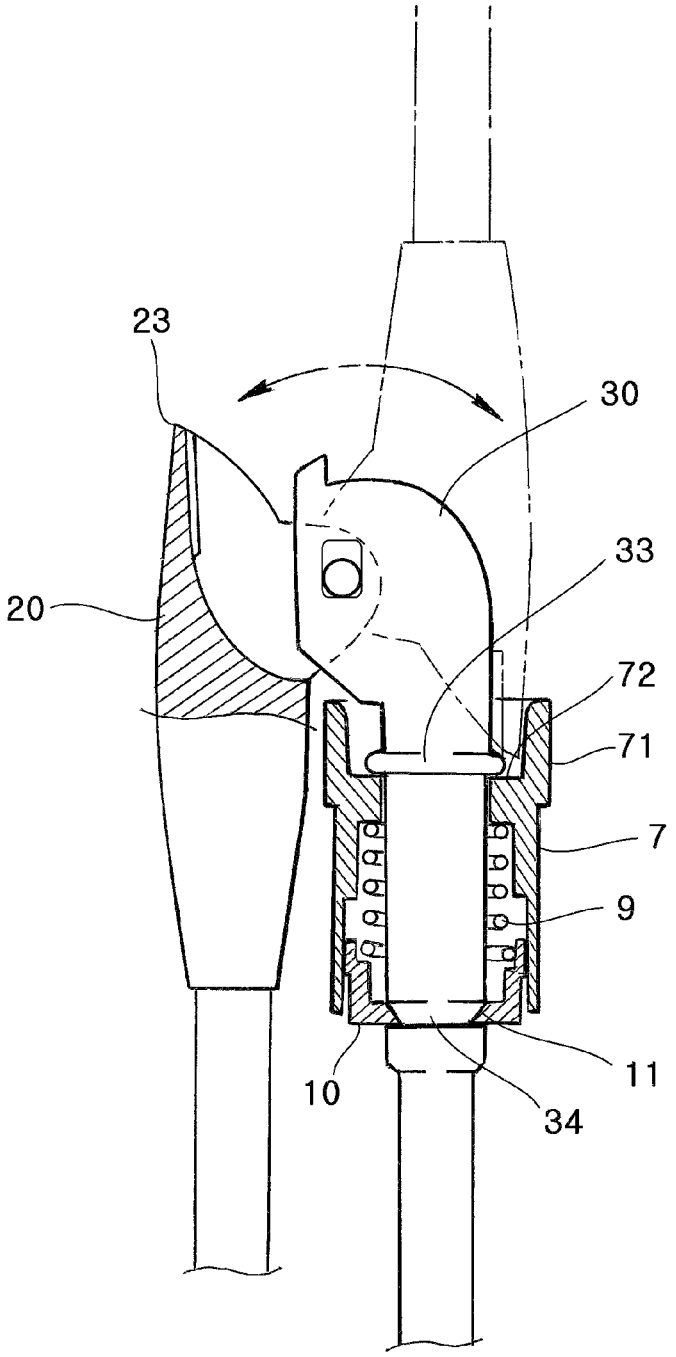
FIG. 6 is an assembly view showing that the spring sheet is inserted into the fastening groove of the frame member of the present invention to support the sleeve.
Figure 7:
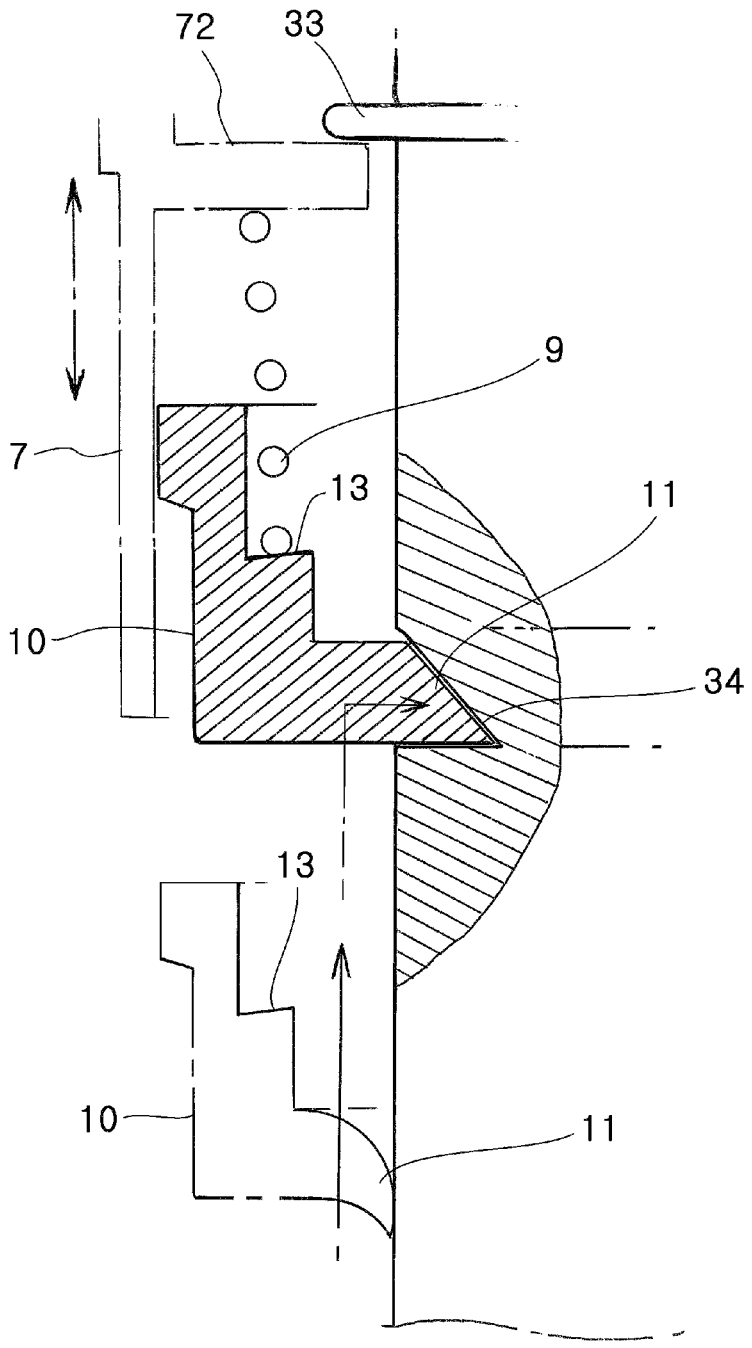
FIG. 7 is a cross-sectional view showing the state in which the spring seat is inserted into the frame member and pushed up (indicated by a virtual line) and the stopper of the spring seat is inserted into the fastening groove and locked.

As shown in FIG. 5, the sleeve (7), spring (9), and spring seat (10) are inserted in this order through the end of the first frame member, but in this state, the spring (9) and the sleeve (7) are unstable. So, as shown in FIG. 7, the spring seat (10) is forcibly pushed up until the stopper (11) falls into the fastening groove (34).

When the spring seat (10) is forcibly pushed up to be installed in this way, the spring (9) is compressed and installed between the sleeve (7) and the spring seat (10) by the force.

In particular, when the spring seat (10) is forcibly pushed up, the stopper (11) at its lower end is elastically pushed down and bent down to be in close contact with the outer peripheral surface of the connection part (31). Then, as the inner end of the stopper (11) enters the fastening groove (34), it is automatically straightened by its restoring force and inserted into the fastening groove (34) and is fixed without movement at the same time.

As such, according to the present invention, the spring seat (10) can be fixed to the frame without welding or bonding, and the stopper (11) once caught by the fastening groove (34) is locked like a wedge and does not fall out unless the spring seat (10) is damaged.

And the spring (9) is compressed to store the expandable elasticity until just before being caught in the fastening groove (34), and the sleeve (7) stops rising at the same time as the bottom (72) of the socket pipe (71) touches the stopper (33).

In the example shown in the drawings, the fastening groove (34) and the stopper (11) are depicted to form a right-angled triangle, but even if it is changed to a trapezoid that becomes thinner toward the inner end of the stopper (11), the effect is similar.

In addition to this, the spring seat (13) is formed in a concave shape to sit at the lower end of the spring (9) stably so that the sleeve (7) does not twist when moving up and down. In addition to the concave type, the same effect can be achieved even if the bottom surface is replaced with a low-inclined surface type.

Figure 8:
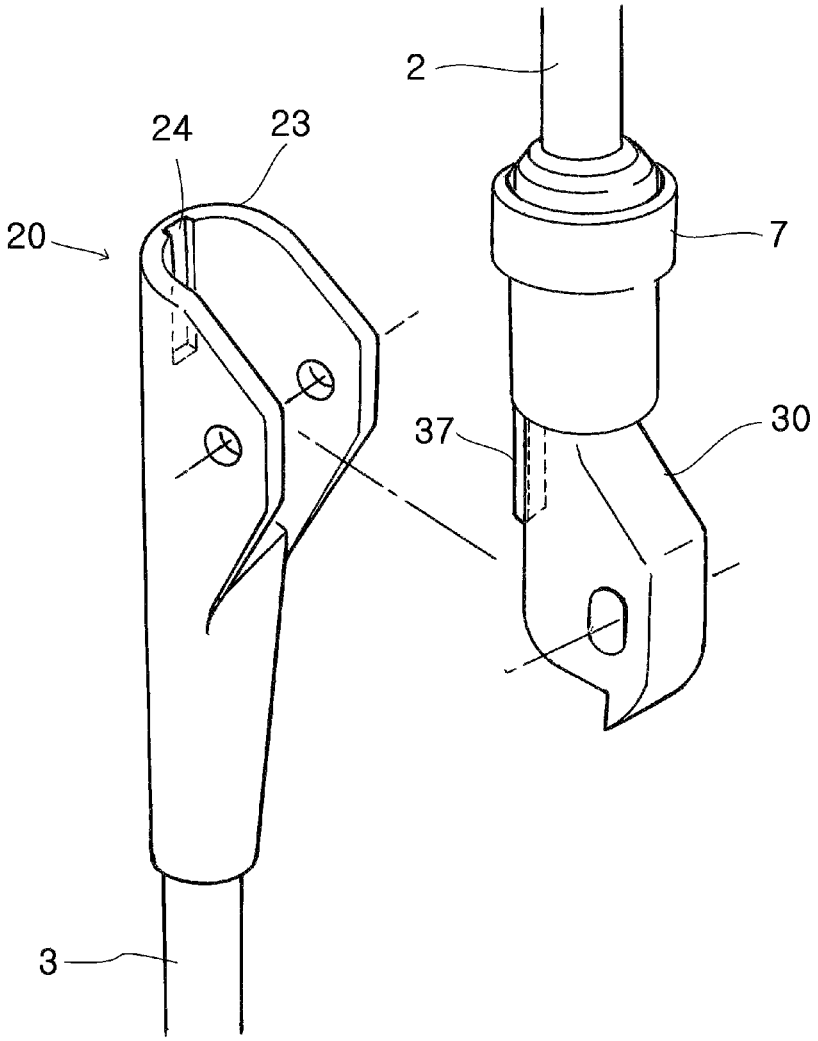
FIG. 8 is an exploded view of a hinge-type connector for implementing the second object of the present invention.

Next, with reference to FIG. 8 and subsequent accompanying drawings, a hinge-type connector for connecting one-touch folding tent frame members to implement the second object of the present invention will be described.

Figure 3:
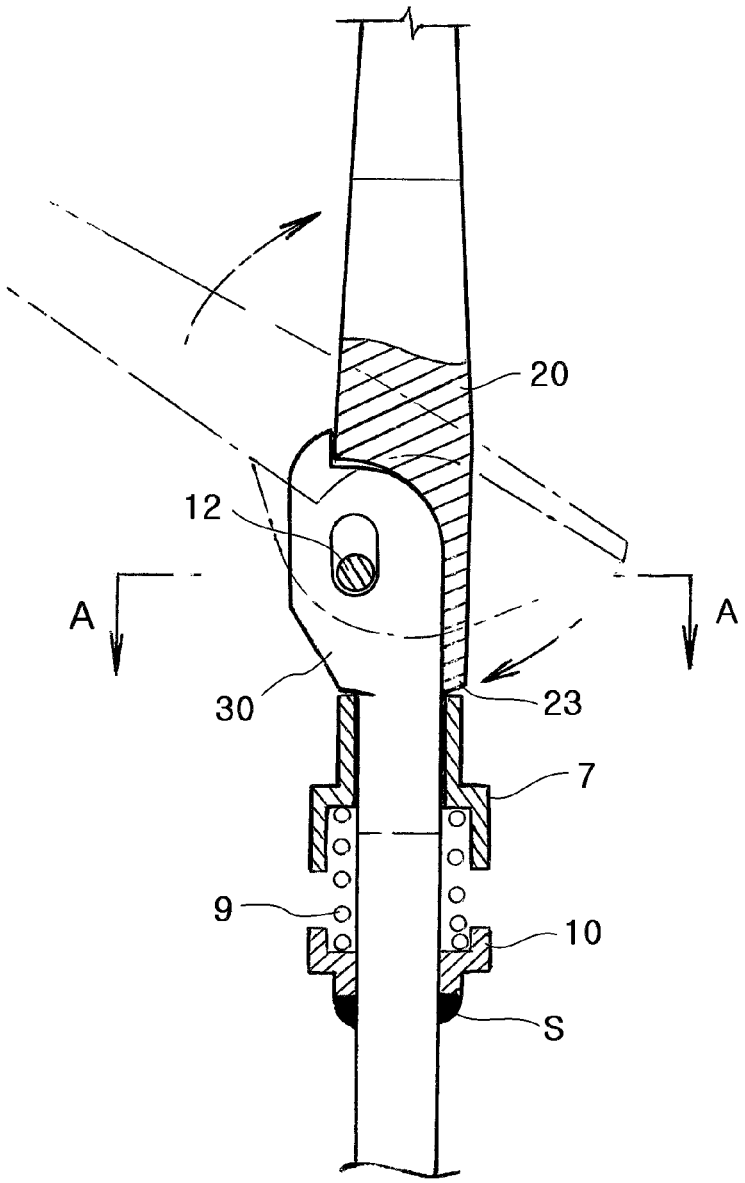
Prior Art FIG. 3
FIG. 3 is a cross-sectional view showing the structure of a conventional hinge-type connector.
Figure 4:
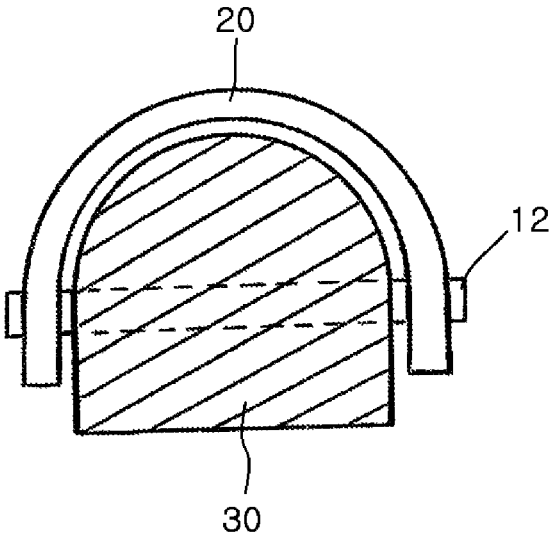
Prior Art FIG. 4
FIG. 4 is an enlarged cross-sectional view taken along lines A-A of FIG. 3.

First, the drawing shown in FIG. 4, which is a plan cross-sectional view of a conventional hinge-type connector, and an enlarged cross-sectional view taken along lines A-A of FIG. 3, is presented for technical comparison with the present invention.

This figure shows a gap due to an injection error between the swing hinge (20) and the fixed hinge (30) made of synthetic resin. Depending on the degree of the gap, there may be differences, but if a strong wind or gust of wind arrives from the side of the frame when the tent is pitched, or if someone passing by the tent steps on the frame, the long-connected frame member may be twisted. If a severe impact is applied to the frame member, the fixed hinge may be deformed by the hinge shaft being compressed, or the wings of the swing hinge may be damaged. Shaking and separation of the hinge may cause damage.

The second object of the present invention is to effectively prepare for such a case.

Figure 9:
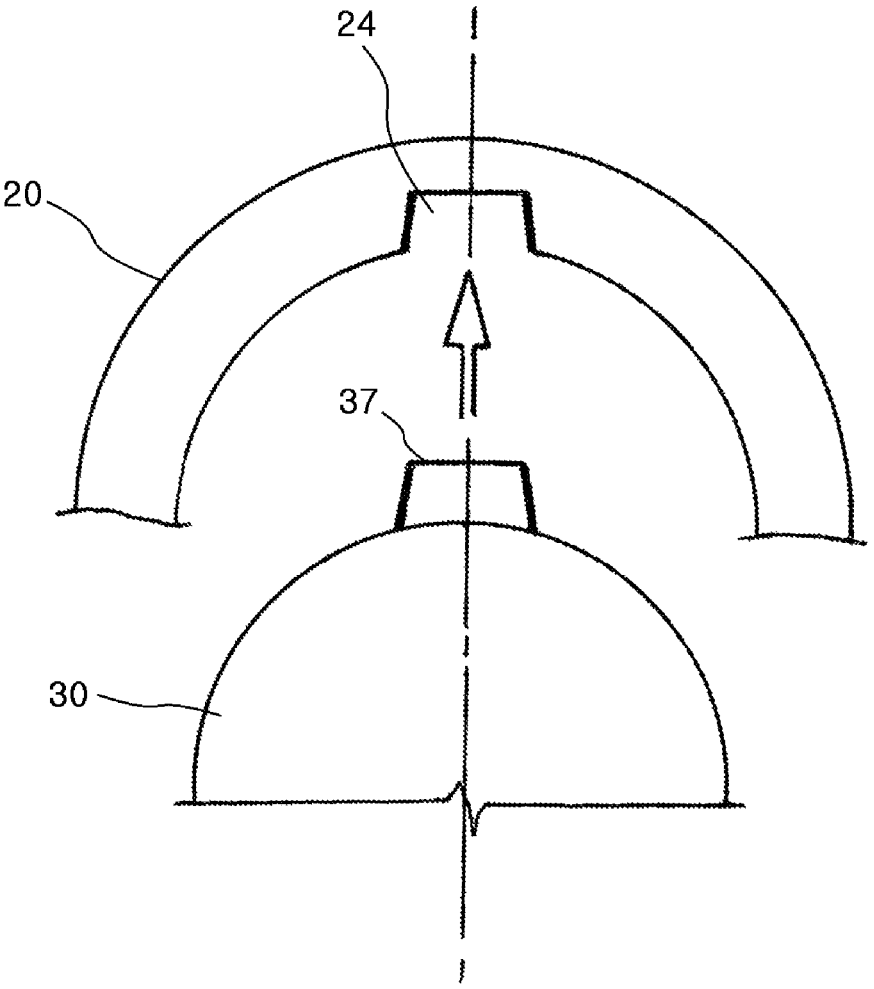
FIG. 9 is a state diagram in which the swing hinge and the fixed hinge are separated.

As shown in FIG. 9, the keyway (24) is formed on the inner circumferential surface of the swing hinge (20), and the key (37) to be fitted to the keyway (24) is formed on the outer circumferential surface of the fixed hinge (30). The keyway (24) is located at the center of the curved section on the U-shaped inner circumferential surface of the swing hinge (20), and the key (37) is formed at the same position as the keyway (24) on the outer circumferential surface of the fixed hinge (30).

Figure 10:
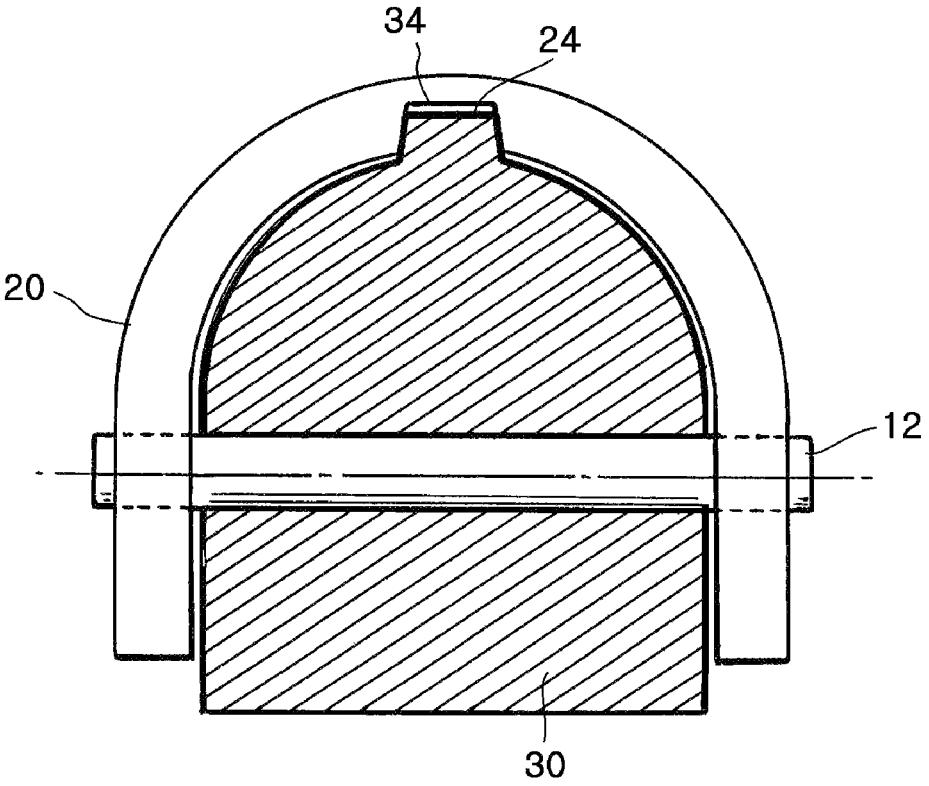
FIG. 10 is a state diagram showing that the key is inserted into the keyway and locked by the combination of the swing hinge and the fixed hinge.

As shown in FIGS. 9 and 10, when the swing hinge (20) is unfolded while turning around the hinge shaft (12), the key (37) is inserted obliquely from the top to the bottom while approaching the keyway (24). This is a very natural phenomenon because the turning radius of the key (37) originates from the center of the hinge shaft.

It is preferable that the key (37) and the keyway (24) are closely matched. For this, a trapezoid is suitable for both, and the length of the key and keyway should be long for a strong connection between the male and female sides while reducing the gap to a minimum to ensure the stability of the connection.

The above-described keyway and key structure may be reversed. In other words, even if a keyway is formed on the inner surface of the swing hinge and a key is formed on the outer surface of the fixed hinge, the locking effect is the same.

The final state is shown in FIG. 10. Once the key (37) is completely inserted into the keyway (24), even if there is a gap between the swing hinge (20) and the fixed hinge (30), the fixed hinge (30) does not wobble from side to side on the hinge shaft (12) and does not move in the circumferential direction. Therefore, the connection between the base frame and the first frame member and between the first frame member and the 3rd frame member is solidified, so even if a strong wind or a gust of wind arrives in the unfolded tent, it can support the sturdy installation without movement, or even if the frame is touched violently a person passing by the tent, the tent frame can be safely protected without damage.

The invention claimed is:

1. A folding tent frame comprising a frame member and a further frame member connected by a hinge-type connector, wherein the further frame member comprises a fastening groove, wherein the hinge-type connector comprises:

a swing hinge attached to a first end of the frame member, wherein the swing hinge comprises a locking lug and a keyway formed on an inner circumferential surface of the swing hinge;

a fixed hinge attached to a first end of the further frame member, wherein the fixed hinge comprises a key formed on an outer circumferential surface of the fixed hinge, wherein the keyway of the swing hinge is configured to receive the key of the fixed hinge;

a hinge shaft configured to connect the swing hinge and the fixed hinge;

a sleeve, installed on the fixed hinge and axially movable on the fixed hinge;

a spring seat fixed to the further frame member by force fitting an inner part of the spring seat, having a corresponding shape and structure as the fastening groove of the further frame member, into the fastening groove of the further frame member; and a spring, installed between the sleeve and the spring seat, configured to apply pressure to the sleeve in an axial direction toward where the swing hinge resides when the tent frame is unfolded, wherein when the tent frame is unfolded, the spring is configured to urge the sleeve along the fixed hinge, over the locking lug of the swing hinge to lock the locking lug between an outer surface of the fixed hinge and an inner surface of the sleeve to prevent swinging of the swing hinge.

2. The folding tent frame according to claim 1, wherein the spring seat is formed in a concave shape for stably seating an end of the spring so that the spring is not twisted or deformed when expanded or compressed.

3. The folding tent frame according to claim 1, wherein the inner part of the spring seat comprises a stopper having an inner diameter that is smaller than the outer diameter of the connection part of the further frame member so that the spring seat is installed by force fitting the stopper into the fastening groove.

4. The folding tent frame according to claim 3, wherein the stopper is formed with a tapered end and has flexibility and bending elasticity.

5. The folding tent frame according to claim 1, wherein the keyway of the swing hinge and the key of the fixed hinge are aligned such that the key meets the inner surface of the swing hinge and the keyway meets the outer surface of the fixed hinge.

6. The folding tent frame according to claim 1, wherein the key is located at the center of the curved section on a U-shaped inner circumferential surface of the swing hinge, and the key is formed at a position corresponding to the keyway on the outer circumferential surface of the fixed hinge.

7. The folding tent frame according to claim 1, wherein an end of the sleeve, which is configured to move over the locking lug of the swing hinge, comprises a socket pipe configured to lock the locking lug between an outer surface of the fixed hinge and an inner surface of the socket pipe to prevent swinging of the swing hinge.

* * * * *